US012583658B2

(12) United States Patent
Topfer et al.

(10) Patent No.: US 12,583,658 B2
(45) Date of Patent: Mar. 24, 2026

(54) CARRIER

(71) Applicant: MULTI PACKAGING SOLUTIONS UK LIMITED, Nottingham (GB)

(72) Inventors: Kevin Topfer, Bradford (GB); Nigel Davis, Nottingham (GB); David Yates, Bradford (GB)

(73) Assignee: Multi Packaging Solutions UK Limited (GB)

( * ) Notice: Subject to any disclaimer, the term of this patent is extended or adjusted under 35 U.S.C. 154(b) by 307 days.

(21) Appl. No.: 18/092,625

(22) Filed: Jan. 3, 2023

(65) Prior Publication Data

US 2023/0219733 A1 Jul. 13, 2023

Related U.S. Application Data

(62) Division of application No. 16/742,226, filed on Jan. 14, 2020, now Pat. No. 11,542,081.

(30) Foreign Application Priority Data

Jan. 15, 2019 (GB) ..... 1900566

(51) Int. Cl.
*B65D 75/36* (2006.01)
*B65B 5/02* (2006.01)
(Continued)

(52) U.S. Cl.
CPC ..... *B65D 75/366* (2013.01); *B65B 5/02* (2013.01); *B65B 43/10* (2013.01); *B65D 75/522* (2013.01)

(58) Field of Classification Search
CPC .. B65D 75/366; B65D 75/522; B65D 5/4802; B65D 5/48022; B65D 5/5038; B65B 5/02; B65B 43/10
(Continued)

(56) References Cited

U.S. PATENT DOCUMENTS 1,356,588 A 10/1920 Bacher
1,631,080 A * 5/1927 Baker ..... B65D 5/5038 211/10
(Continued)

FOREIGN PATENT DOCUMENTS

CN 207090068 U 3/2018
DE 9102785 U1 5/1991
(Continued)

OTHER PUBLICATIONS

Extended European Search Report dated May 11, 2021, Application No. 20209929.7, Previously Cited in Parent U.S. Appl. No. 16/742,226.
(Continued)

*Primary Examiner* — Luan K Bui
(74) *Attorney, Agent, or Firm* — Brian J. Goldberg; Rohini K. Garg; Tsugihiko Suzuki

(57) ABSTRACT

A carrier (2) made of cardboard, paperboard or other lightweight foldable sheet material, comprises a top sheet (4) defining one or more pockets (20) for receiving one or more products and a bottom sheet (6) attached to the top sheet (4). The top sheet (4) comprises one or more respective sets (30) of flaps (32) for forming the respective pockets (20), each flap (32) being hingedly connected at a proximal end (36) to a top surface (38) of the top sheet (4) about a respective flap hinge line (40) defined around an upper edge (42) of the respective pocket (20) and folded about the respective flap hinge line (40) to define a pocket side wall. The top sheet (4) further comprises respective tabs (50) hingedly connected to distal ends (46) of the respective flaps (32) about respective tab fold lines (52) and folded about a respective tab fold line (52) so as to lie along a base of the pocket (20). The bottom sheet (6) is bonded to the respective tabs (50) in a face to face relationship to close at least a portion the base of the pocket (20).

20 Claims, 10 Drawing Sheets

(51) Int. Cl.
*B65B 43/10* (2006.01)
*B65D 75/52* (2006.01)

(58) Field of Classification Search
USPC ..... 206/476–478, 480, 482–483, 486, 488, 206/528, 561, 562, 581, 722, 725, 206/763–765, 767, 783, 784
See application file for complete search history.

(56) References Cited

U.S. PATENT DOCUMENTS

| | | | | |
|---|---|---|---|---|
| 1,922,571 | A | 8/1933 | Deline | |
| 2,258,716 | A * | 10/1941 | Ralph | B65D 71/72 206/521.6 |
| 3,489,269 | A | 1/1970 | Rosenberg, Jr. | |
| 3,595,382 | A * | 7/1971 | Hofer | B65D 5/4204 229/162.1 |
| 4,469,271 | A * | 9/1984 | Kulig | B65D 71/72 206/813 |
| 5,407,076 | A | 4/1995 | Sabet | |
| 6,474,473 | B2 | 11/2002 | Wong | |
| 11,124,345 | B1 * | 9/2021 | Hockin | B65D 77/26 |
| 2004/0000500 | A1 * | 1/2004 | Hsu | B65D 5/5038 206/486 |
| 2008/0073418 | A1 | 3/2008 | Hsu | |
| 2020/0223580 | A1 | 7/2020 | Topfer | |
| 2020/0223610 | A1 | 7/2020 | Topfer | |

FOREIGN PATENT DOCUMENTS

| | | | |
|---|---|---|---|
| DE | 29803952 | U1 | 7/1999 |
| EP | 0103535 | A2 | 3/1984 |
| EP | 0441102 | A1 | 8/1991 |
| EP | 2594506 | A1 | 5/2013 |
| EP | 2610194 | A1 | 7/2013 |
| EP | 2746186 | A1 | 6/2014 |
| FR | 72561 | E | 4/1960 |
| FR | 1478568 | A | 4/1967 |
| FR | 1490713 | A | 8/1967 |
| FR | 2129295 | A5 | 10/1972 |
| FR | 2902410 | A1 | 12/2007 |
| GB | 2127785 | A | 4/1984 |
| JP | 2011042372 | A | 3/2011 |
| WO | 03/042070 | A | 5/2003 |

OTHER PUBLICATIONS

Search Report dated Jul. 1, 2019, Application No. GB 1900566.9, Previously Cited in Parent U.S. Appl. No. 16/742,226.
GB Search Report for Application No. 1917122.2, dated Apr. 15, 2020, Previously Cited in Parent U.S. Appl. No. 16/742,226.
UK Search Report dated Apr. 15, 2020, Application No. GB1917122.2, Previously Cited in Parent U.S. Appl. No. 16/742,226.
UK Search Report dated Jul. 1, 2019, Application No. GB1900566.9, Previously Cited in Parent U.S. Appl. No. 16/742,226.
Copending U.S. Appl. No. 17/104,046, filed Nov. 25, 2020, Previously Cited in Parent U.S. Appl. No. 16/742,226.
European Search Report for Application No. 20151790, dated Apr. 30, 2020, Previously Cited in Parent U.S. Appl. No. 16/742,226.
European Search Report for Application No. 20151797, dated Apr. 8, 2020, Previously Cited in Parent U.S. Appl. No. 16/742,226.

* cited by examiner

CARRIER

TECHNICAL FIELD

The present invention relates to a carrier for a product, made of cardboard, paperboard or other lightweight foldable sheet material. The invention also extends to a blank for such a carrier, and a method of erecting the blank. The carrier may locate one or more products in a desired position relative to an outer package, or may itself form part of a package, such as a blister pack.

BACKGROUND

It is often necessary to be able to locate certain products in a desired position within a package. For example, this may particularly important where multiple products are located within a single package e.g. a multi-pack. It may be necessary to locate product(s) within the package so as to enable them to be viewable by a user from the exterior of the package e.g. such that they are aligned with window(s) or apertures in the package. Various types of product may be presented in this manner, including, but not limited to, food item(s), such as confectionary, or cosmetic products. One example of such a package would be a seasonal selection pack.

Considerable difficulties may be involved in ensuring that product(s) remain aligned relative to the package after assembly within the package throughout shipping and until the product(s) are ultimately removed from the package by a user.

Previously, products have been located in a desired position within a package using a moulded plastic insert. However, for environmental reasons, there is a growing need to provide packaging which is more easily recyclable, and which may avoid the use of plastic. In other arrangements, products have been located within a package using locating means formed of cardboard or paperboard, and integral with the outer package. Such means may automatically erect itself when the outer package is erected, or may require manual erection. The product is then loaded into the locating means with the locating means already within the outer package. It has been recognised that such arrangements are not suitable for high speed, high volume machine erection.

Moreover, many products are displayed in plastic blister packs. The blister pack includes a moulded plastic pod for receiving the product and a foil closure. However, such packages are becoming environmentally less popular.

SUMMARY OF THE INVENTION

The present invention is directed to a carrier which is made of cardboard, paperboard or other lightweight foldable sheet material. In certain embodiments the carrier may receive and locate one or more products in a desired position relative to an outer package. In other embodiments, the carrier may form part of a stand-alone package.

From a first aspect, the invention provides a carrier made of cardboard, paperboard or other lightweight foldable sheet material. The carrier comprises a top sheet defining one or more pockets for receiving one or more products and a bottom sheet attached to the top sheet and closing, at least in part, the bases of the respective pockets. The top sheet comprises respective sets of flaps for forming respective pockets in the top sheet, each flap being hingedly connected at a proximal end to an upper surface of the top sheet about a respective flap hinge line defined around an upper edge of the respective pocket and folded about the respective flap hinge line to define a pocket side wall. The top sheet further comprises respective tabs hingedly connected to the distal ends of the respective flaps about respective tab fold lines and folded about a respective tab fold line so as to lie along a bottom portion of the pocket. The bottom sheet is bonded to the respective tabs in a face to face relationship to close, at least in part, the bottom of the pocket.

It will be appreciated that the Applicant reserves the right to claim this subject matter alone or in combination with any of the features described herein, and not limited to the additional features of claim 1. It will be further appreciated that any of the features described herein may be incorporated in embodiments in accordance with the claims.

Thus in accordance with the invention, two sheets of cardboard, paperboard or other lightweight foldable sheet material are joined together to form the carrier. This avoids the need to use plastic material as a carrier. Moreover, the carrier allows products to be located in the respective pockets prior to the insertion of the carrier into an outer container or the closure of the carrier, thereby facilitating the packaging of the product.

In some embodiments, one or more of the flaps of a set may be angled so as to create a tapering pocket. This arrangement may be advantageous in that it may allow the position of the product within the pocket to be controlled so as to allow the product to sit at the correct height relative to the upper surface of the pocket, while accommodating a range of product depths. Tapering of the pockets may also allow multiple carriers to more easily be nested. This may enable multiple carriers to be provided in a more compact arrangement for shipping, for example where carriers are assembled at one location and then shipped to a different location for filling with product.

In other embodiments, however, the flaps may be substantially perpendicular to the pocket upper surface to create a non-tapering pocket.

The flaps may be generally trapezoidal in shape, tapering from the flap hinge line towards the tab hinge line. However, the particular flap shape will be determined by the product to be received, the pocket size and arrangement. Thus in other embodiments, for example, the flaps may be generally rectangular.

The number of flaps in each set and their arrangements will be determined by the shape of the product to be received in the pocket. In some embodiments, each pocket may be defined by opposed pairs of flaps. In a simple embodiment, a rectangular pocket may be defined by four flaps, arranged in two opposed pairs.

In certain embodiments, a single flap may be provided on each side of the pocket. In other embodiments, however, more than one flap may be provided.

In certain embodiments, the flaps may define substantially the entire associated wall of the pocket. However, depending on the shape of the pocket and the size of the product received in the pocket, the flap may define only a part of the associated wall.

In some embodiments, the bottom sheet may comprise flaps which may fold up to cover openings formed in the side walls of the pockets between the top sheet flaps. The bottom sheet flaps may overlap the top sheet flaps and if necessary be bonded to retain them in position.

In some embodiments, the tabs on a first pair of opposed tabs may be aligned with each other along a longitudinal axis of the pocket, and the tabs on another (or the other) pair of opposed flaps may be offset from one another relative to a transverse axis of the pocket in a direction along the longitudinal axis of the pocket. This may allow better nesting of the tabs and also facilitate application of glue to the tabs prior to bonding. Such embodiments may incorporate any of the features described herein. For example, the number and arrangement of the flaps may, for example, be in accordance with any of the above described examples.

In a particular embodiment, the tabs of the top sheet are arranged in a row along the longitudinal axis, with the aligned tabs being arranged at the ends of the row and the offset tabs arranged between the aligned tabs.

In order to assist in retaining a product within the pocket, one or more locating tabs may extend inwardly from the top edge of each pocket. The locating tab may be released from the respective flap attached to that edge. Thus the locating tab may interrupt the flap hinge line, which will then be formed on opposite sides of the flap hinge line.

The bottom sheet in some embodiments may be formed as a completely separate sheet from the top sheet. However, in other embodiments, the top sheet and bottom sheet are connected along respective edges thereof by a side panel hingedly connected to the respective side edges. This may facilitate erection of the carrier as no separate feed for the bottom sheet will be required.

The bottom sheet may substantially close the bottom of the pocket. However, in some embodiments, for example where the carrier is being used as a blister type pack, it may be desirable to be able to see the product within the pocket. Accordingly in some embodiments, the bottom sheet may be provided with one or more apertures aligned with the pocket.

As discussed above, the carrier of the invention may be used in a number of ways.

In some embodiments, the carrier may be used to collate and locate one or more products within a package. In some embodiments, therefore, the filled carrier may be received in an external package. The invention also extends to such a filled package. One could envisage, for example, multiple articles of confectionary being arranged in this manner.

In other embodiments, the carrier itself forms part of a package such as a blister pack or closed tray. In certain embodiments, therefore, a cover sheet may be attached over the pockets. The cover sheet is advantageously also made of cardboard, paperboard or other lightweight foldable sheet material.

The invention therefore also extends to a container comprising a carrier in accordance with the invention further comprising a cover sheet mounted over the at least one pocket of the carrier to retain product within the at least one pocket.

The cover sheet may be adhesively attached to the top sheet to close the at least one pocket.

In some embodiments, the cover sheet may be formed completely separately from the top sheet. In other embodiments, however, the cover sheet may be formed integrally with the top sheet, for example hingedly attached thereto about a fold line.

The invention also extends to a blank of cardboard, paperboard or other lightweight foldable sheet material for producing the top sheet of a carrier in accordance with the invention.

Thus the invention also provides blank of cardboard, paperboard or other lightweight foldable sheet material comprising a sheet comprising one or more sets of flaps defined therein by cut lines, each flap of a set being hingedly connected to the sheet at a proximal end to about a respective flap hinge line, the flap hinge lines of a set of flaps being arranged to define an edge of a respective pocket and foldable out of the sheet to define side walls of the pocket. The sheet further comprises respective tabs defined therein by cut lines, each tab being hingedly connected to a distal end of a respective flap about a respective tab fold line and foldable about the tab fold line so as to lie along a bottom portion of the pocket.

The flaps in some embodiments, may be generally trapezoidal in shape, tapering from the flap hinge line towards the tab hinge line. However, the particular flap shape will be determined by the product to be received, the pocket size and arrangement. Thus in other embodiments, for example, the flaps may be generally rectangular.

The number of flaps in each set and their arrangements will be determined by the shape of the product to be received. In some embodiments, each pocket may be defined by opposed pairs of flaps. In a simple embodiment, a rectangular pocket may be defined by four flaps, arranged in two opposed pairs.

In some embodiments, the tabs on a first pair of opposed tabs may be aligned with each other along a longitudinal axis of the pocket, and the tabs on the other pair of opposed flaps are offset from one another relative to a transverse axis of the pocket in a direction along the longitudinal axis of the pocket. This may allow better nesting of the tabs.

In a particular embodiment, the tabs are arranged in a row along the longitudinal axis, with the aligned tabs being arranged at the ends of the row and the offset tabs arranged between the aligned tabs.

In order to assist in retaining a product within the pocket, one or more locating tabs may extend inwardly from the top edge of each pocket. The locating tab is released from the respective flap attached to that edge. Thus the locating tab may interrupt the flap hinge line, which will then be formed on opposite sides of the flap hinge line.

The blank may further comprise a second sheet integrally formed with the sheet and connected along a side edge to a side edge of the sheet by a side panel hingedly connected between the respective side edges.

The blank may also, in certain embodiments comprise a cover sheet integrally connected to an edge thereof about a hinge line.

The invention also extends to a method of making a carrier in accordance with the invention from a blank in accordance with the invention.

The method comprises folding the flaps of the respective sets of flaps about their respective flap hinge lines to form side walls of the respective pockets, folding the tabs about the respective tab hinge lines to a bonding position and bonding the bottom sheet to the tabs to close the respective pockets.

The folding of the flaps and tabs may be effected simultaneously or consecutively.

As discussed above, the bottom sheet may be hingedly attached to the top sheet or separate therefrom prior to bonding.

In an embodiment, the folding comprises pressing a pocket forming tool into the blank to fold the flaps and tabs out of their initial, planar positions. In embodiments, the forming tool is remains engaged with the carrier during bonding to retain the shape of the pocket. Using a forming tool is advantageous in that it will allow the shape of the pocket to be consistently reproduced.

The bonding may comprise passing a glue gun or wheel over the tabs, placing the bottom sheet over the glued tabs and pressing the tabs and bottom sheet together.

In some embodiments, the application of glue to the tabs is effected prior to formation of the pockets, so as to facilitate application of the glue. Thus in some embodiments, the glue is applied to carrier blank in its flat format.

After formation of the carrier, the carrier may be filled with product and inserted into a container, and/or or have a cover sheet bonded thereto. The container into which the carrier is inserted in some embodiments may be a pre-erected carton.

BRIEF DESCRIPTION OF THE DRAWINGS

An embodiment of the invention will now be described, by way of example only, with reference to the accompanying drawings in which.

DETAILED DESCRIPTION

Figure 1:
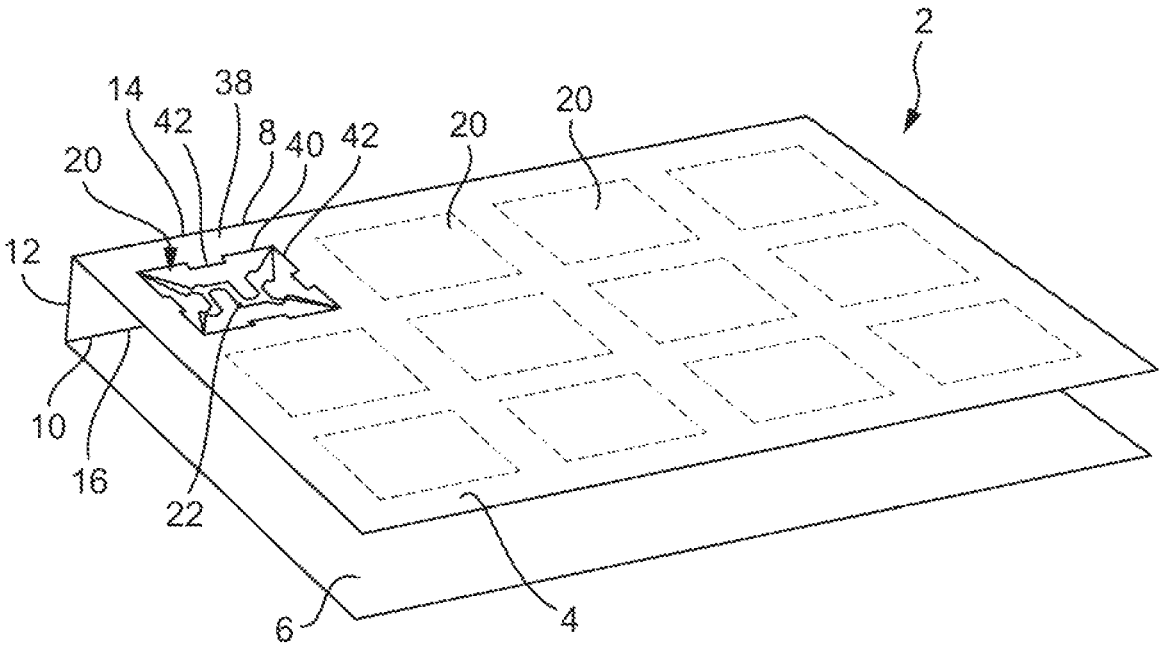
FIG. 1 shows a carrier in accordance with the invention.

With reference to FIG. 1, a first embodiment of carrier 2 in accordance with the invention comprises a top sheet 4 and a bottom sheet 6. In this embodiment, the top sheet 4 is connected to the bottom sheet 6 along respective edges 8, 10 thereof by a side panel 12 which is hingedly connected to the respective side edges 8, 10 by respective hinge lines 14, 16. In an alternative embodiment, the top sheet 4 and bottom sheet may be formed as separate sheets which are not connected along their side edges 8, 10.

The top sheet 4 defines a plurality of pockets 20 for receiving one or more products (not shown). In this embodiment, twelve pockets 20 are formed in three rows; however other numbers and arrangements of pockets 20 may be contemplated. A single pocket 20 may also be produced in accordance with the invention. For purposes of illustration details are shown for only one of the pockets 20 in FIG. 1, and flaps of the pockets (described below) are illustrated in an intermediate position, not yet attached to the bottom panel 6 by tabs 50 (also described below).

The bottom sheet 6 is attached to the top sheet 4 and closes, at least in part, the bases 22 of the respective pockets 20, as will be described further below. As can be seen from FIG. 2, in this embodiment, the bottom sheet 6 is a continuous sheet having no openings defined therein.

Figure 2:
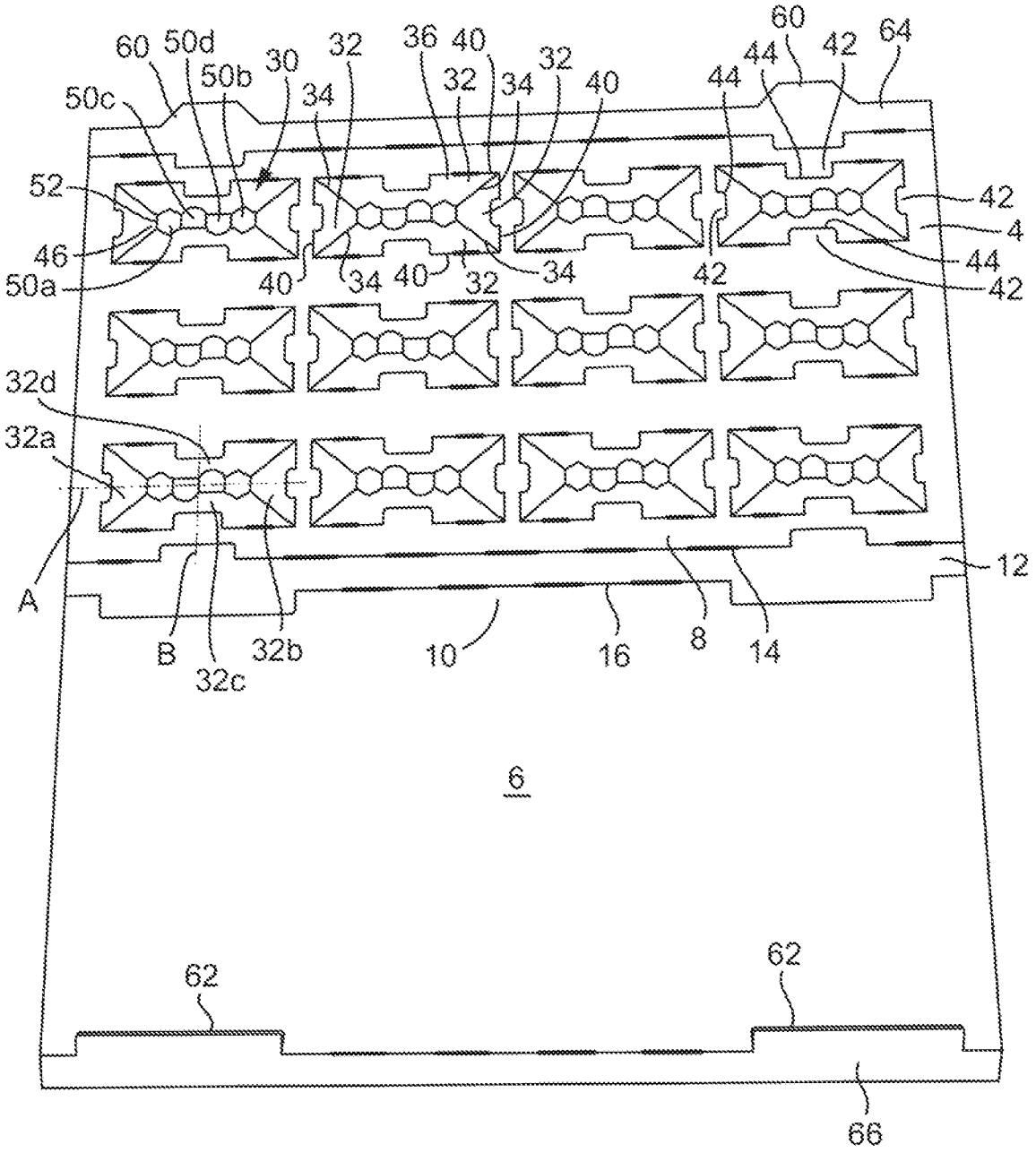
FIG. 2 shows a blank for making the carrier of FIG. 1.

Referring to FIGS. 1 and 2, the top sheet 6 is formed with respective sets 30 of flaps 32 for forming side walls of the respective pockets 20. As can be seen from FIG. 2, the flaps 32 are formed by respective cut lines 34 in the sheet material. Each flap 32 is hingedly connected at a proximal end 36 to a top surface 38 of the top sheet 4 about a respective flap hinge line 40 defined around an upper edge 42 of the respective pocket 20.

In this embodiment, each set 30 of flaps 32 comprises four flaps 32, arranged in first and second opposed pairs of flaps 32*a*, 32*b* and 32*c*, 32*d*. The first pair of flaps 32*a*, 32*b* is arranged along a longitudinal axis A of the pocket 20 and the second pair of flaps is arranged along a transverse axis B of the pocket 20. The respective flap hinge lines 40*a*, 40*b* of each flap 32*a*, 32*b* of the first pair of flaps will therefore extend parallel to the transverse axis B of the pocket 20 and the respective flap hinge lines 40*c*, 40*d* of each flap 32*c*, 32*d* of the second pair of flaps will therefore extend parallel to the longitudinal axis A of the pocket 20. In this embodiment the longitudinal axis A is along the longer dimension of the pocket 20 but in other embodiments, it may be across a shorter dimension.

Each flap 32 is generally trapezoidal in shape, tapering inwardly from the associated flap hinge line 40 in a direction towards the centre of the pocket 20. Of course in other embodiments, the flaps 32 may have a different shape, such as rectangular. While rectangular pockets 20 have been illustrated in this embodiment, other shapes and sizes of pocket 20 can be created, using suitable flap arrangements.

The flaps 32 are angled inwardly so that the pocket 20 tapers in the direction towards the bottom sheet 6. The angle can be chosen such that a product sits within the pocket 20 at an appropriate level relative to the top surface of the top sheet 4. As mentioned above, tapering of the pockets may also enable a carrier to be produced which is of a form which may more easily be nested with other such carriers e.g. for compact shipping. In some contexts, it is envisaged that carriers may be assembled at one location, and shipped to other location(s) for filling with product.

Each flap hinge line 40 in this embodiment is interrupted by a locating tab 42 which extends into the pocket 20 from the top surface 38 of the top sheet 4. These tabs 42 may act to assist in holding the product firmly in the pocket 20 as they will be deformable to some extent so as to grip the product. In other embodiments, the tabs may overlie a portion of a received product and thereby assist in preventing it from moving upwardly out of the pocket 20. As can be seen, the locating tabs 42 are released from the flaps 30 and defined by cut lines 44. In other embodiments, locating tabs 42 need not be provided at all sides of the pocket 20.

Each flap 40 has a distal end 46. A tab 50 is hingedly attached to the distal end 46 of the flap 40 about a tab fold line 52. It can be seen from FIG. 2 that the tabs 50 are formed by a series of tab cut lines 55 which also define, in part, the distal ends 46 of some flaps 40.

In this embodiment, the tabs 50*a*, 50*b* attached to the first pair of flaps 32*a*, 32*b* are aligned with each other along the longitudinal axis A of the respective pocket 20 and the tabs 50*c*, 50*d* on the other pair of flaps 32*c*, 32*d* are offset from one another relative to the transverse axis B of the pocket 20 in a direction along the longitudinal axis A of the pocket 32. This arrangement allows the tabs 50 to be arranged in a row along the longitudinal axis A of the pocket 20, with the aligned tabs 50*a*, 50*b* arranged at the ends of the row and the offset tabs 50*c*, 50*d* being arranged between the aligned tabs 50*a*, 50*b*. Accordingly, this may facilitate easier application of glue at a gluing station (described below) as glue may be applied in a straight line along the aligned and offset tabs 50*a*, 50*b*, 50*c*, 50*d*. As can be seen in FIG. 2, in the blank 100, the tabs 50*a* . . . 50*d* are contiguous, although as can be seen in FIGS. 1 and 3, when the pocket 20 has been formed they move apart from one another, creating an opening 54 at the base 56 of the pocket 20.

In this embodiment, the tabs 50*a*, 50*b* of the first pair of opposed tabs are hexagonal in shape, which provides a relatively large surface are for boding to the bottom sheet 6. However, the tabs 50*a*, 50*b* may have other shapes, for example generally rectangular or square. The tabs 50*c*, 50*d* of the second pair of tabs are generally rectangular in shape, but may also have other shapes if desired.

Figure 3:
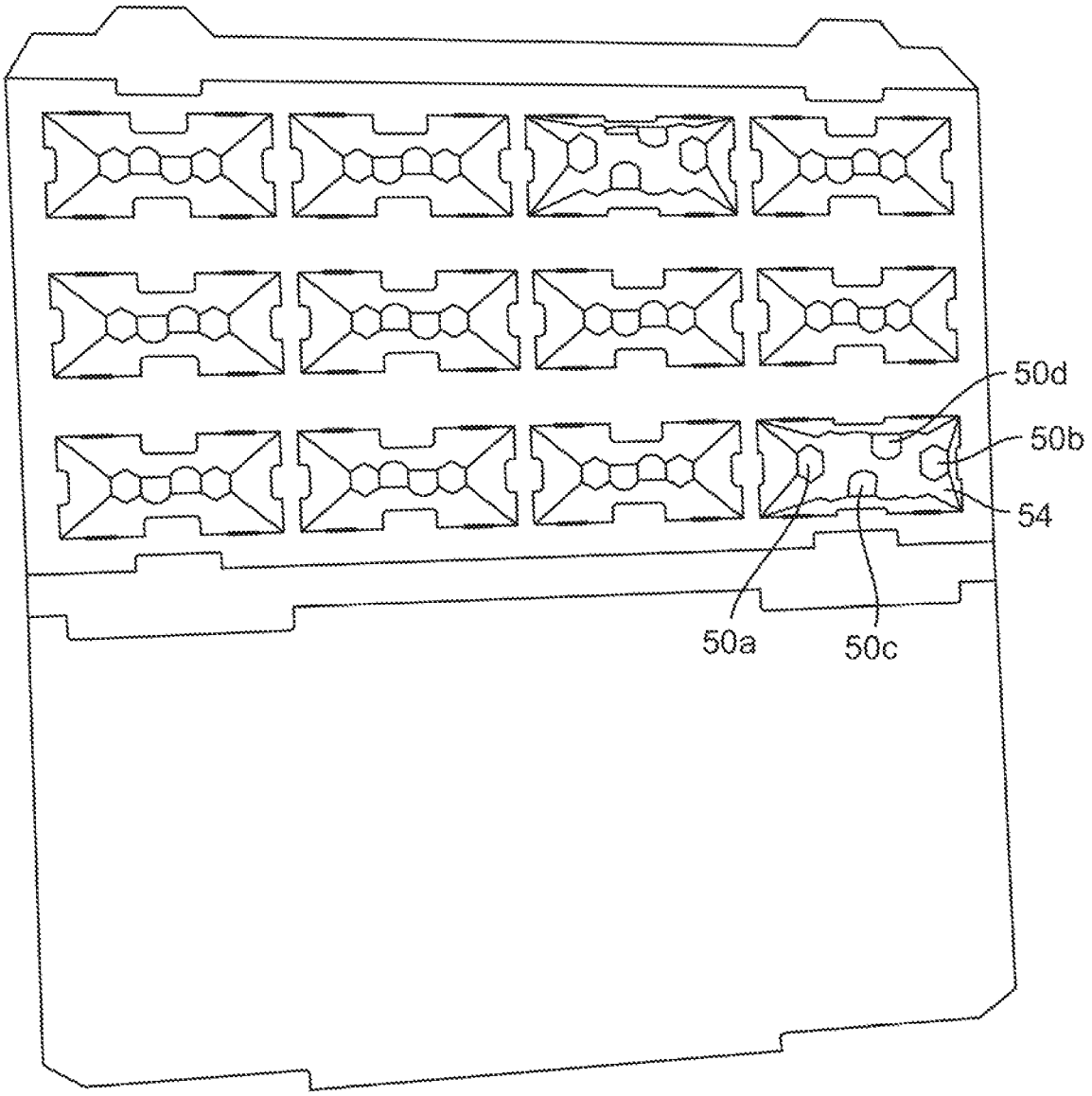
FIG. 3 shows the blank of FIG. 2 in which a number of pockets have been formed.

As can be seen from FIG. 3, which illustrates a blank 100 after some pockets 20 have been formed therein, the tabs 50 are folded about the tab hinge lines 52 so as to lie in a common plane. This plane is parallel to the upper surface 38 of the top sheet 4. The bottom sheet 6 is bonded, for example glued, to the tabs 50 in order to close the openings 54 at the base of each pocket 20. The bonding may, for example, be achieved by application of glue to the tabs 50 or by thermally bonding the bottom sheet 6. For purposes of illustration only two of the pockets 20 are shown as having been formed.

In this embodiment, as discussed above, the bottom sheet 6 is attached to the top sheet 4 via the side panel 12 as this may facilitate erection of the carrier. The top sheet 4 and bottom sheet 6 may also comprise additional tabs 60 and slots 62 defined in hinged panels 64, 66 on their free edges. When the bottom sheet 6 is folded over the top sheet 4, the panels 64, 66 may also be folded such that the tabs 60 engage in the slots 62 to close the side of the carrier 2 opposite the side panel 12. This may facilitate insertion of the insert into a package at a later stage.

Figure 4:
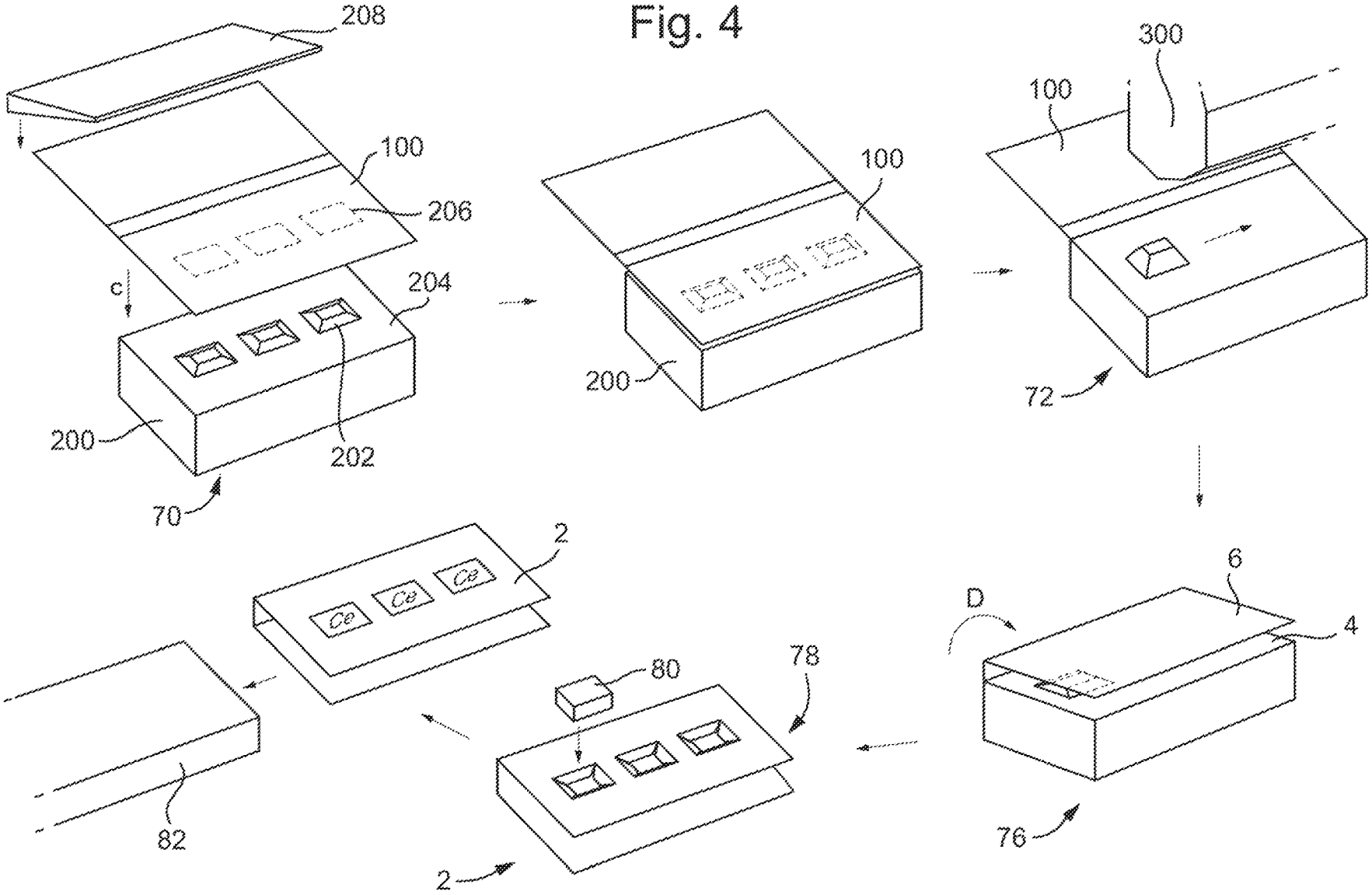
FIG. 4 illustrates schematically a sequence of making the carrier from the blank of FIG. 2.
Figure 5:
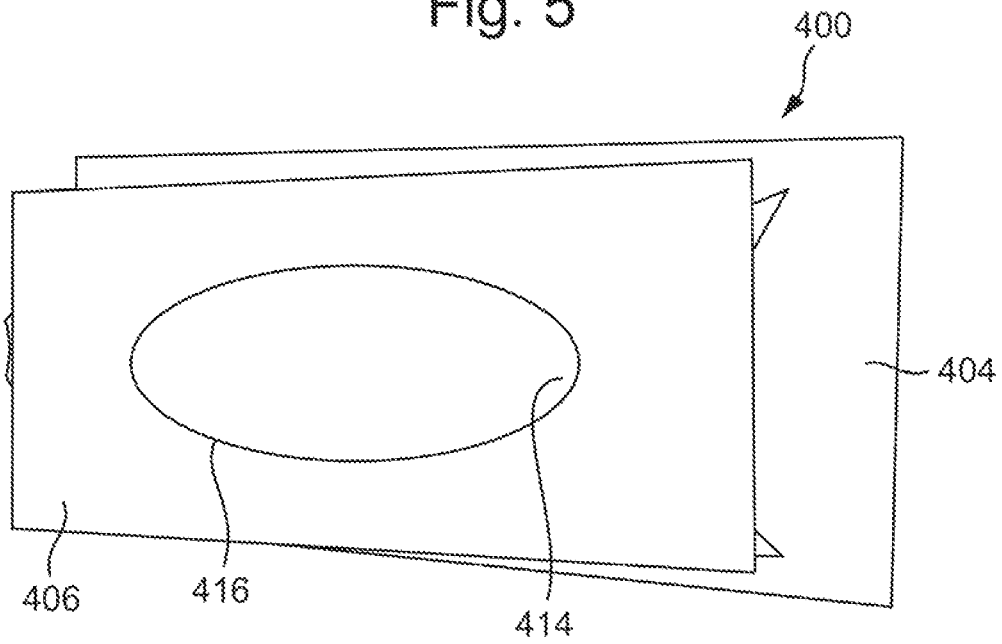
FIG. 5 shows a container in accordance with the invention.
Figure 6:
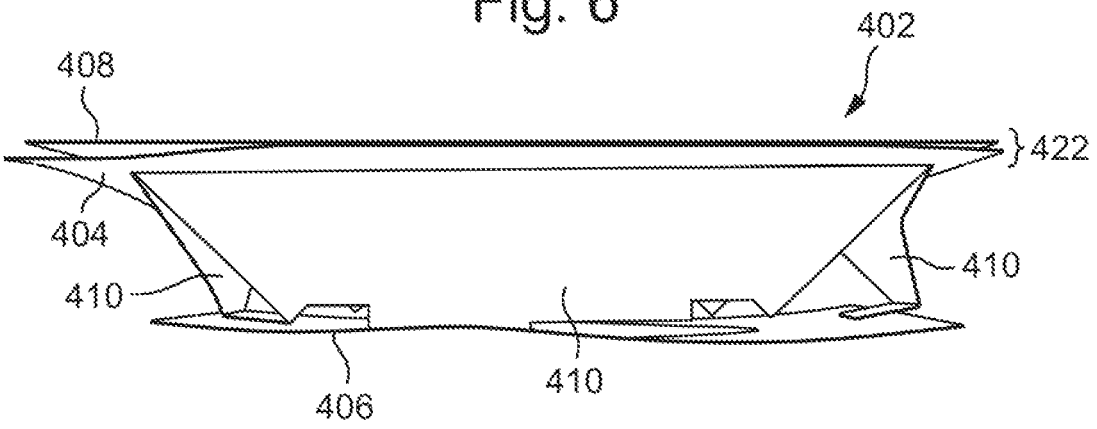
FIG. 6 shows a side view of the container of FIG. 5.
Figure 7:
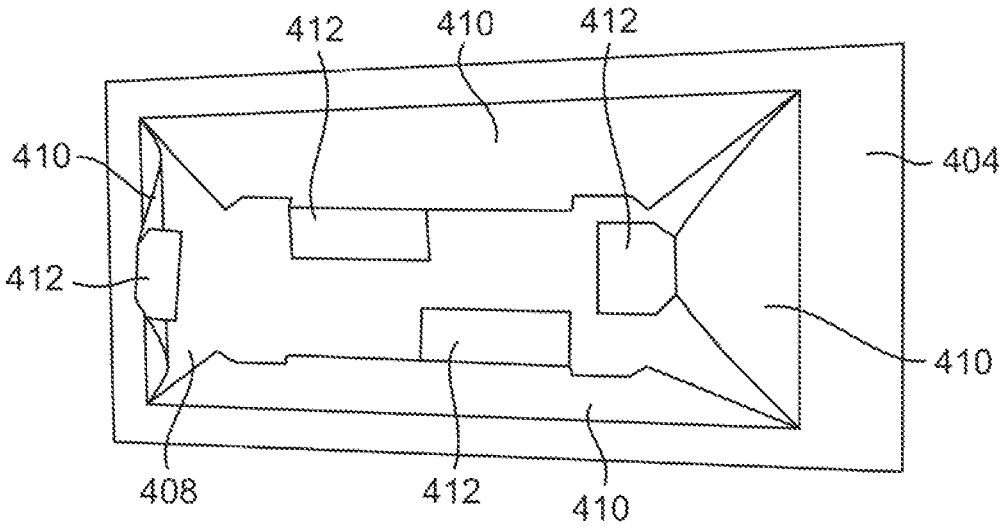
FIG. 7 shows a view of the container of FIG. 5 with its bottom sheet removed.
Figure 8:
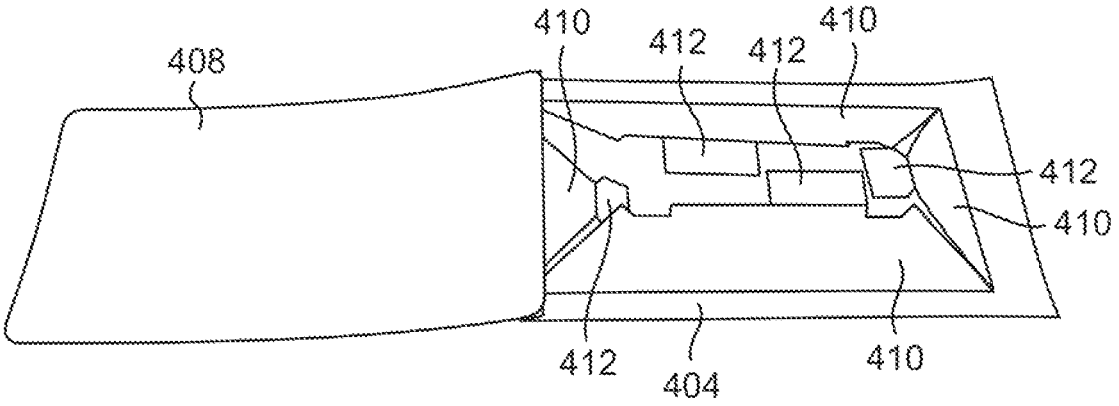
FIG. 8 shows a view of the container of FIG. 5 with its bottom sheet removed and its cover sheet folded back.
Figure 9:
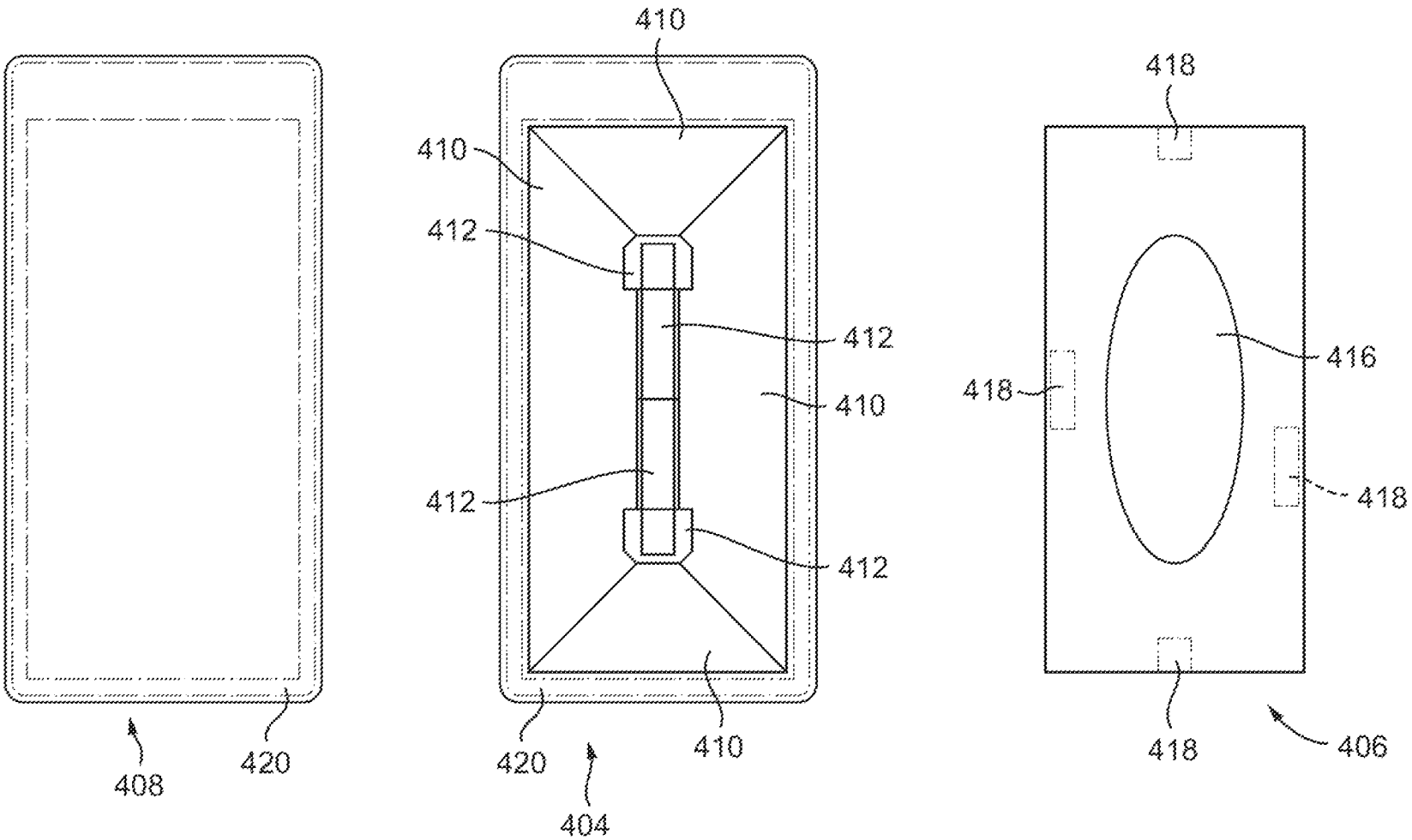
FIG. 9 shows the blanks of the top sheet, bottom sheet and cover sheet of the container of FIG. 5.

FIG. 4 illustrates schematically a sequence by which the carrier 2 may be erected from the blank 100.

At station 70, a blank 100 is placed onto a pocket former 200. In this embodiment, the pocket former 200 is a die having projections 202 formed on its upper surface 204 which correspond in position to the pocket forming features 206 on the blank 100. The blank 100 and former are brought together as illustrated by arrow C such that the projections 202 hinge the flaps 32 about their hinge lines 34. The tabs 50 are then folded over by a plate 208 which is brought down on top of the hinged flaps 32. The tabs 50 will be folded over on top of the projections 202.

The plate may then be withdrawn and the formed blank 100 and former 200 moved on together to a gluing station 72. At the gluing station, the blank 100 is moved under a glue gun or glue wheel 300 which applies a suitable glue to the folded tabs 50.

The former 200 and blank 100 are then moved to a folding station 76 in which the bottom sheet 6 of the blank is folded over the top sheet 4 by a suitable folding mechanism, as illustrated by arrow D. Such mechanisms are well known in the art. The top sheet is pressed into firm contact with the folded-over bottom sheet 6 so as to firmly bond the bottom sheet 6 to the tabs 50. The former 200 acts as an anvil against which suitable pressure may be applied.

If the additional side panels 64, 66 are present as discussed above, further folding may be effected by suitable means to bring these panels 64, 66 into engagement.

For purposes of illustration, only one pocket is illustrated at the gluing station 72 and folding station 76.

The formed carrier 2 may then be removed from the former and moved to a filling station 78 at which product 80 may be deposited in the pockets 20 of the carrier 2.

Finally, the filled carrier 2 may then be inserted into a container 82 at a packing station 400.

While a die has been illustrated as the pocket former 200 in FIG. 4, the pocket former could, in an alternative embodiment, be a belt with suitable formations 202 formed thereon. This would allow the belt not only to transport the blank 100 through the various manufacturing stations, but also to effect forming of the pockets 20.

The described carrier 2 therefore allows products to be supported in a container without the use of plastic materials and also facilitates packing.

Turning now to the embodiment of FIGS. 5-9, a second embodiment of the invention is illustrated. In this embodiment, rather than being used as a support for supporting one or more products in an external container, the carrier 400 is an integral part of a package 402.

The carrier 400 comprises a top sheet 404 and a bottom sheet 406. The package 400 further comprises a cover sheet 408 bonded to the top sheet 404.

As in the earlier embodiment, the top sheet 404 comprises a plurality of flaps 410 and tabs 412. In this embodiment, the flaps 410 are also generally trapezoidal and form sloping side walls of a single pocket 414.

Unlike the earlier embodiment, however, the bottom sheet 406, rather than being a continuous sheet, has an aperture 416 through which the interior space of the pocket 414 may be viewed. The tabs 412 of the top sheet 404 will be bonded to the bottom sheet 406 at locations 418 around the aperture 416.

As discussed above, the carrier 400 of this embodiment is a part of a container 402 which contains a cover sheet 408 bonded to the top sheet 404. As is illustrated schematically in FIG. 9, glue may be applied around peripheral regions 420 of the top sheet 404 and/or cover sheet 408 to effect the bonding. As in the earlier embodiment, other forms of bonding, for example heat sealing may be used.

The container 402 may, as shown, have a peripheral flange 422 where the top sheet 404 and cover sheet 408 overlap. The cover sheet 408 and/or top sheet 404 could be formed with hanger holes or other formations in the flange 422 to facilitate display of the container 402. In particular embodiments, the hanger holes or the like could be provided in a wider section 424 of the flange 422.

The carrier 400 of this embodiment may be erected in a similar manner to that of the first embodiment, a product then filled into the pocket 414 and the cover sheet 408 then attached to the top sheet 404 to close the container 402.

Turning now to FIGS. 10 to 14, a third embodiment of the invention is disclosed.

This embodiment is a similar to the second embodiment above, but with differently shaped flaps. Whereas in the second embodiment the flaps 410 are generally trapezoidal and substantially close the sides of the tapering pocket 414, in this embodiment, the flaps 410 are generally rectangular and create a pocket 414 which has vertical, rather than sloping walls.

Figure 10:
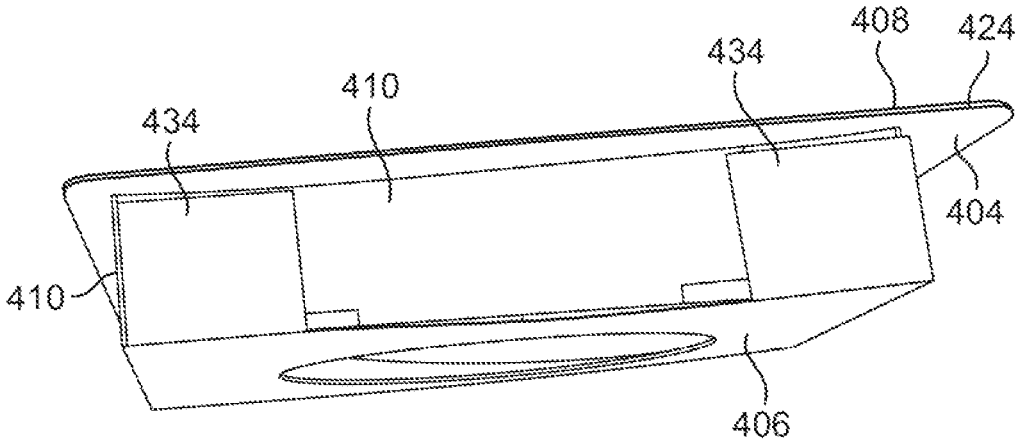
FIG. 10 shows a perspective view of a further container in accordance with the invention.
Figure 13:
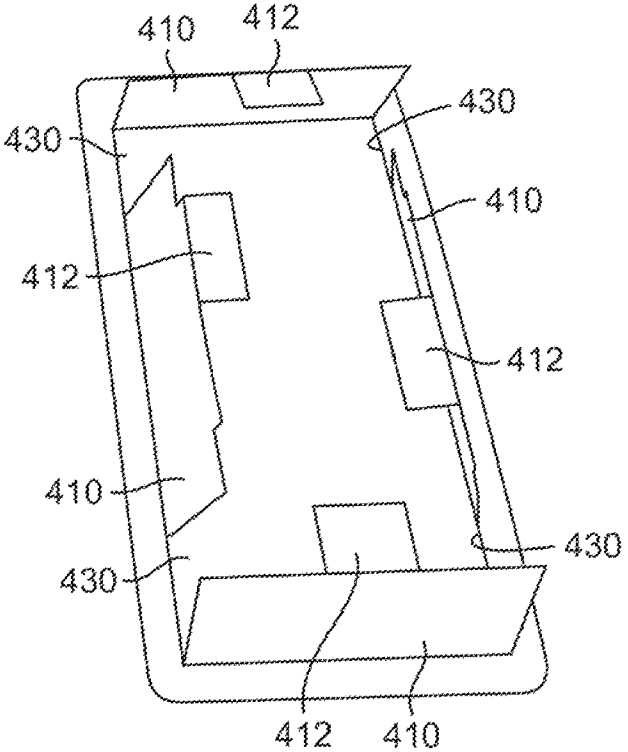
FIG. 13 shows a perspective view of the top sheet of the container of FIG. 10.
Figure 12:
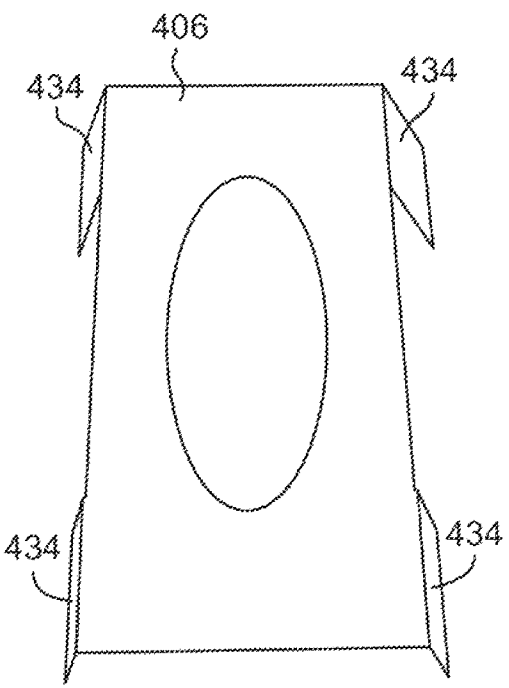
FIG. 12 shows a perspective view of the bottom sheet of the container of FIG. 10.
Figure 11:
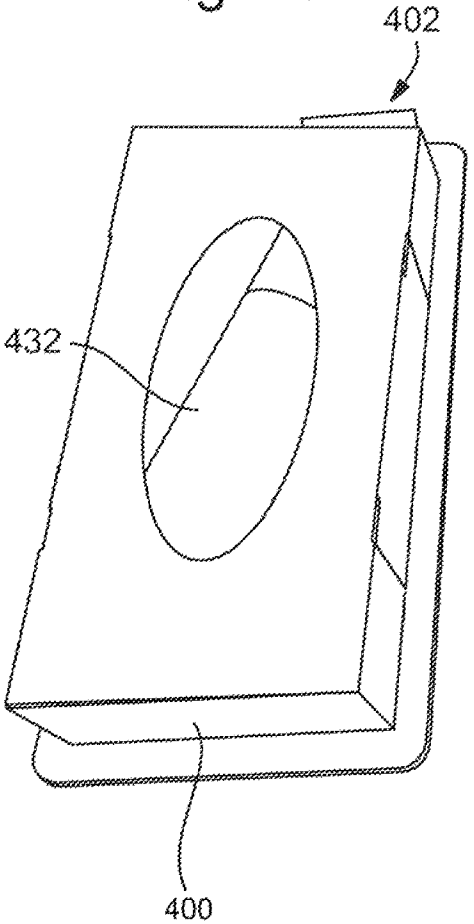
FIG. 11 shows a further perspective view of the container of FIG. 10.
Figure 14:
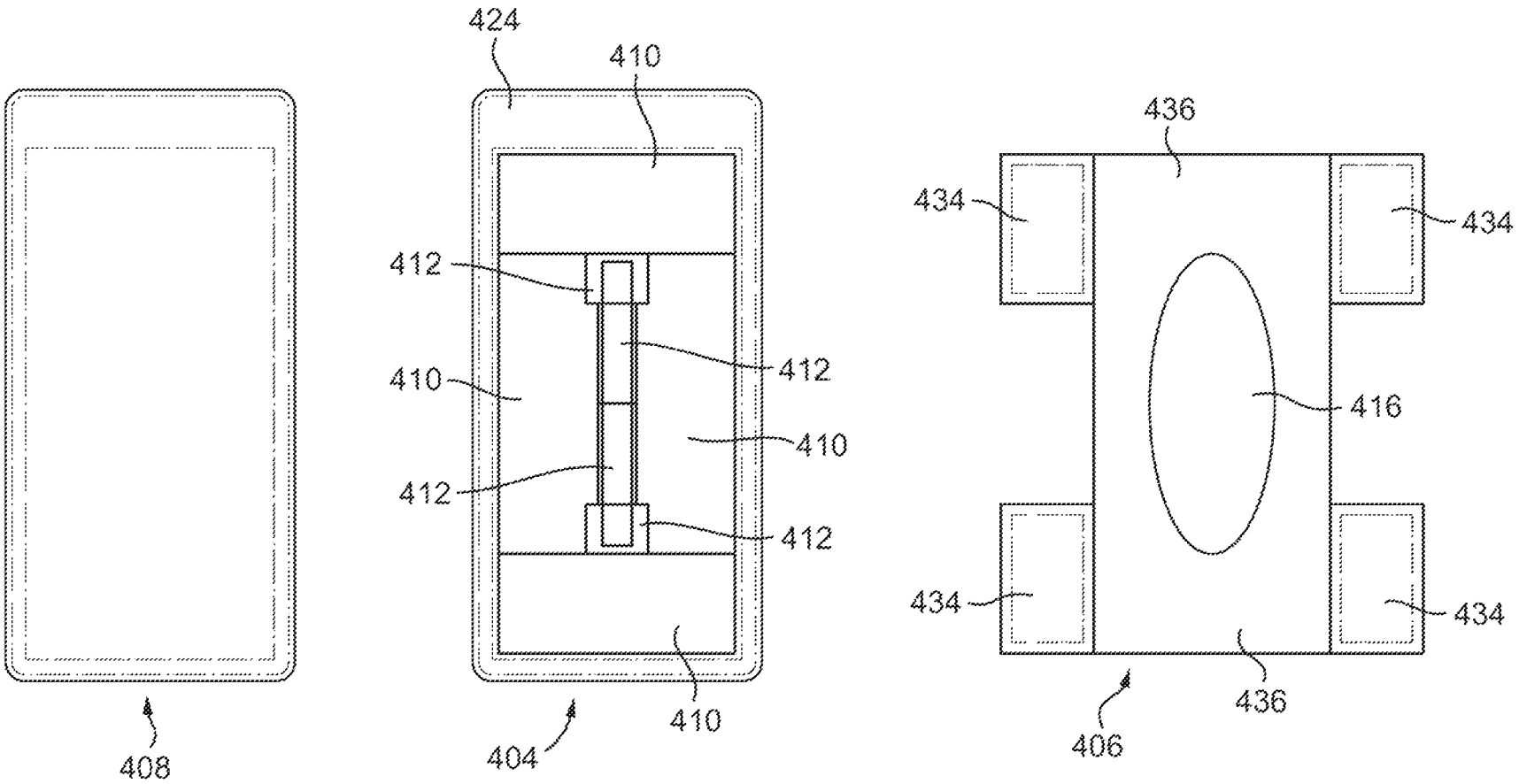
FIG. 14 shows the blanks of the top sheet, bottom sheet and cover sheet of the container of FIG. 10.

Due to the rectangular (rather than trapezoidal) shape of the flaps 410, sizable gaps 430 are formed in the end regions of the longitudinal sides of the pocket 414. To prevent a product 432 falling through these gaps 430, the bottom sheet 406 is formed with flaps 434 at its ends 436 which in the erected carrier 400 are folded up and attached to the top sheet flaps 410 as shown in FIG. 10 to close the gaps 430.

The other features of the third embodiment are the same as those of the second embodiment and need not, therefore be defined in detail again.

It will be appreciated that the embodiments described above are exemplary only and that various modifications may be made thereto without departing from the scope of the invention. For example, features of the different embodiments may be interchanged as appropriate. For example, the carrier 100 of the first embodiment may be provided with a cover sheet as in the second and third embodiment and the bottom sheet 6 of that embodiment may only partially close the base of each pocket such that at least a portion of the base of the pocket 20 remains open. Conversely, in the second and third embodiments, the cover sheet may be omitted. In any of the embodiments, whether or not a cover sheet is used, a filled carrier may be inserted into a container, e.g. a pre-erected carton. Thus, after formation of the carrier, the carrier may be filled with product and inserted into a container, and/or have a cover sheet bonded thereto.

Also, the third embodiment may also be adapted to produce tapering pockets 414 as in the second embodiment by suitable sizing of the flaps 410.

List Of Exemplary Embodiments

For the avoidance of doubt, the numbering of the embodiments below refers to the numbering of the embodiments in this list of embodiments.

Embodiment 1. A carrier (2) made of cardboard, paperboard or other lightweight foldable sheet material, comprising:

a top sheet (4) defining one or more pockets (20) for receiving one or more products; and a bottom sheet (6) attached to the top sheet (4);

wherein the top sheet (4) comprises one or more respective sets (30) of flaps (32) for forming the respective pockets (20), each flap (32) being hingedly connected at a proximal end (36) to a top surface (38) of the top sheet (4) about a respective flap hinge line (40) defined around an upper edge (42) of the respective pocket (20) and folded about the respective flap hinge line (40) to define a pocket side wall;

the top sheet (4) further comprising respective tabs (50) hingedly connected to distal ends (46) of the respective flaps (32) about respective tab fold lines (52) and folded about a respective tab fold line (52) so as to lie along a base of the pocket (20);

the bottom sheet (6) being bonded to the respective tabs (50) in a face to face relationship to close at least a portion the base of the pocket (20).

Embodiment 2. A carrier as set out in embodiment 1, wherein one or more flaps of each set (50) is angled so as to define a tapering pocket.

Embodiment 3. A carrier as set out in embodiment 1 or 2, wherein each pocket (20) is defined by opposed pairs of flaps (50*a*, 50*b*, 50*c*, 50*d*).

Embodiment 4. A carrier as set out in embodiment 3, comprising four flaps (50*a*, 50*b*, 50*c*, 50*d*), arranged in two opposed pairs.

Embodiment 5. A carrier as set out in embodiment 4, wherein the tabs (50*a*, 50*b*) on a first pair of opposed flaps (32*a*, 32*b*) are aligned with each other along a longitudinal axis (A) of the pocket (20) and the tabs (50*c*, 50*d*) on the other pair of opposed flaps (32*c*, 32*d*) are offset from one another relative to a transverse axis (B) of the pocket (20) in a direction along the longitudinal axis (A) of the pocket (20).

Embodiment 6. A carrier as set out in embodiment 5, wherein the tabs (50*a*, 50*b*, 50*c*, 50*d*) are arranged in a row along the longitudinal axis (A) of the pocket (20), with the aligned tabs (50*a*, 50*b*) arranged at the ends of the row and the offset tabs (50*c*, 50*d*) arranged between the aligned tabs (50*a*, 50*b*).

Embodiment 7. A carrier as set out in any preceding embodiment, further comprising one or more locating tabs (42) extending inwardly from the top edge of each pocket (20).

Embodiment 8. A carrier as set out in embodiment 7, wherein the locating tab (42) is released from the respective flap (50) attached to that edge.

Embodiment 9. A carrier as set out in any one of the preceding embodiments, wherein the top sheet (4) and bottom sheet (6) are connected along respective edges thereof by a side panel (12) hingedly connected to the respective side edges.

Embodiment 10. A carrier as set out in any one of the preceding embodiments, wherein, the bottom sheet (406) further comprises one or more flaps (434) which are folded up to cover openings (430) formed in the side walls of the pockets (414) between the top sheet flaps (410), the bottom sheet flaps (434) optionally overlapping the top sheet flaps (410) and being bonded thereto.

Embodiment 11. A carrier as set out in any one of the preceding embodiments, wherein, the bottom sheet (406) further comprises one or more apertures (416) formed therein whereby the contents of a pocket (414) may be accessed or viewed.

Embodiment 12. A carrier as set out in any one of the preceding embodiments, further comprising a cover sheet (408) attached over the top sheet (404) to close the one or more pockets in the carrier (400).

Embodiment 13. A container comprising a carrier as set out in any one of the preceding embodiments received therein.

Embodiment 14. A blank (100) of cardboard, paperboard or other lightweight foldable sheet material, for producing a top sheet (4) of a carrier (2) as set out in embodiment 1, the blank (100) comprising:

a sheet (4) comprising one or more sets (30) of flaps (32) defined therein by cut lines (34), each flap (32) of a set (30) being hingedly connected to the sheet at a proximal end (36) to about a respective flap hinge line (40), the flap hinge lines (40) of a set (30) of flaps (32) being arranged to define an edge of a respective pocket (20) and foldable out of the sheet to define side walls of the pocket (20);

respective tabs (50) defined therein by cut lines (55), each tab (50) being hingedly connected to a distal end (46) of a respective flap (32) about a respective tab fold line (52) and foldable about the tab fold line (52) so as to lie along a base portion of the pocket (20).

Embodiment 15. A blank as set out in embodiment 14 wherein each flap (32) is generally trapezoidal in shape.

Embodiment 16. A blank as set out in embodiment 14 or 15, wherein each set (30) of flaps (32) comprises opposed pairs of flaps (32).

Embodiment 17. A blank as set out in embodiment 16, wherein each set (30) of flaps (32) comprises four flaps (32*a*, 32*b*, 32*c*, 32*d*), arranged in two opposed pairs.

Embodiment 18. A blank as set out in embodiment 17, wherein the tabs (50*a*, 50*b*) on one pair of opposed flaps (32*a*, 32*b*) in each set (30) are aligned with each other, and the tabs (50*c*, 50*d*) on the other pair of opposed flaps (32*c*, 32*d*) are laterally offset from one another.

Embodiment 19. A blank as set out in embodiment 18, wherein the tabs (50*a*, 50*b*, 50*c*, 50*d*) on both pairs of flaps (32*a*, 32*b*, 32*c*, 32*d*) are arranged in a row.

Embodiment 20. A blank as set out in any one of embodiments 14 to 19, further comprising a second sheet (6) integrally formed with the sheet (4) and connected along a side edge to a side edge of the sheet (4) by a side panel (12) hingedly connected between the respective side edges for forming a bottom sheet of the carrier.

Embodiment 21. A method of making a carrier as set out in any of embodiments 1 to 13 from a blank as set out in any of embodiments 14 to 20, comprising:

folding the flaps (32) of the respective sets (30) of flaps (32) about their respective flap hinge lines (34) to form side walls of the respective pockets (20);

folding the tabs (50) about the respective tab hinge lines (52) to a bonding position; and bonding the bottom sheet (6) to the tabs (50) to at least partially close the base of the respective pockets (20).

Embodiment 22. A method as set out in embodiment 21, wherein the folding comprises pressing a pocket forming tool (200) into the blank (100) to fold the flaps (32) and tabs (50).

Embodiment 23 A method as set out in embodiment 21 or 22, wherein the bonding comprises passing a glue gun or wheel (300) over the folded tabs (50), placing the bottom sheet (6) over the glued tabs (50) and pressing the tabs (50) and bottom sheet (6) together, or thermally bonding.

Embodiment 24. A method as set out in embodiment 21, 22 or 23 further comprising filling the one or more pockets with product and then attaching a cover sheet over the filled pockets and/or inserting the carrier into a container, such as a pre-erected carton.

Embodiment 25. A method, blank, container or carrier in accordance with any one of the preceding embodiments wherein each flap is generally trapezoidal or rectangular in shape.

Embodiment 26. A method, blank, container or carrier in accordance with any one of the preceding embodiments wherein each pocket is a rectangular pocket defined by four flaps, arranged in two opposed pairs.

Embodiment 27. A method, blank, container or carrier in accordance with any one of the preceding embodiments wherein a single flap is provided on each side of the pocket.

The invention claimed is:

1. A blank for producing a carrier, the blank comprising:

a top sheet comprising:

one or more sets of flaps defined therein by cut lines, wherein each set of flaps defines a respective pocket of one or more pockets, each of the flaps of the one or more sets being hingedly connected, at a proximal end thereof, to the top sheet along a respective flap hinge line, the flap hinge lines of a set of flaps being arranged to define an edge of a respective pocket and foldable out of the top sheet about the respective flap hinge line to define side walls of the pocket;

tabs defined therein by cut lines, each of the tabs being hingedly connected to a distal end of one of the respective flaps about a tab fold line and configured to be foldable about the tab fold line and to be sized so as to lie along a base portion of the pocket;

wherein each of the one or more sets of flaps comprises four flaps arranged as opposed pairs of flaps, wherein the tabs connected to a first pair of opposed flaps respectively, are aligned with each other, and the tabs connected to a second pair of the opposed flaps are laterally offset from one another.

2. A blank as claimed in claim 1, wherein each flap is generally trapezoidal in shape.

3. A blank as claimed in claim 1, wherein the tabs on both pairs of flaps are arranged in a row.

4. A blank as claimed in claim 1, further comprising a second sheet integrally formed with the top sheet and connected along a side edge to a side edge of the top sheet by a side panel hingedly connected between the respective side edges for forming a bottom sheet of the carrier.

5. A method of making the carrier from the blank as claimed in claim 4, comprising:

folding the flaps of the one or more sets of flaps about respective flap hinge lines to form side walls of the one or more pockets;

folding the tabs about respective tab hinge lines so as to lie along a base of the one or more pockets; and bonding the bottom sheet to the tabs in a face-to-face relationship to at least partially close the base of the one or more pockets.

6. The method as claimed in claim 5, wherein the folding comprises pressing a pocket forming tool into the blank to fold the flaps and tabs.

7. The method as claimed in claim 5, wherein the bonding comprises passing a glue gun or wheel over the folded tabs, placing the bottom sheet over the glued tabs and pressing the tabs and the bottom sheet together, or thermally bonding.

8. The method as claimed in claim 5 further comprising filling the one or more pockets with product and then attaching a cover sheet over the filled pockets.

9. The method as claimed in claim 5 further comprising filling the one or more pockets with product and then inserting the carrier into a container, wherein the container is a pre-erected carton.

10. The blank of claim 1 wherein the tabs connected to the first pair of opposed flaps, respectively, are aligned with each other along a longitudinal axis (A) of the pocket.

11. The blank of claim 10 wherein the tabs connected to the second pair of opposed flaps are offset from one another relative to a transverse axis (B) of the pocket in a direction along the longitudinal axis of the pocket.

12. The blank of claim 11 wherein the tabs are arranged in a row along the longitudinal axis of the pocket, wherein the tabs connected to the first pair of opposed flaps are arranged at the ends of the row and the tabs connected to the second pair of opposed flaps are arranged between the tabs connected to the first pair of opposed flaps.

13. The blank of claim 1, wherein one or more flaps of each set of flaps are angled so as to define a tapering pocket.

14. The blank of claim 1, further comprising one or more locating tabs extending inwardly from the edge of the pocket.

15. The blank of claim 14, wherein each of the one or more locating tabs is released from a corresponding flap attached to that edge.

16. The blank of claim 4 wherein the bottom sheet is configured to be bonded to the tabs in a face-to-face relationship to close at least a portion of the base portion of the pocket, wherein the bottom sheet is configured to be attached to the top sheet.

17. The blank of claim 4, wherein the bottom sheet further comprises one or more bottom flaps which are folded up to cover openings formed in the pocket side wall between the flaps of the top sheet.

18. The blank of claim 1, wherein the cutlines define, at least in part, a distal end of one or more of the flaps.

19. The blank of claim 1, wherein each of the tabs is separated from its respective flap at least by the tab fold line.

20. A blank for producing a carrier, the blank comprising:

a top sheet defining one or more pockets; and a bottom sheet attached to the top sheet; wherein the top sheet comprises one or more sets of flaps, each set of flaps for forming a respective pocket of the one or more pockets, each of the flaps being hingedly connected at a proximal end to a top surface of the top sheet about a flap hinge line defined around an edge of the respective pocket and folded about the flap hinge line to define a pocket side wall; wherein the top sheet further comprises tabs, each of the tabs hingedly connected to a distal end of one of the flaps about a tab fold line and folded about the tab fold line so as to lie along a base of the pocket; wherein the bottom sheet is bonded to the tabs in a face-to-face relationship configured to close at least a portion of the base of the pocket; and wherein each of the one or more sets of flaps comprises four flaps arranged as opposed pairs of flaps, wherein the tabs connected to a first pair of opposed flaps, respectively, are aligned with each other along a longitudinal axis (A) of the pocket and the tabs connected to a second pair of opposed flaps, respectively, are offset from one another relative to a transverse axis (B) of the pocket in a direction along the longitudinal axis (A) of the pocket.

* * * * *